US008181564B2

(12) United States Patent
Rosu et al.

(10) Patent No.: US 8,181,564 B2
(45) Date of Patent: May 22, 2012

(54) FUEL PUMP

(75) Inventors: Cristian A. Rosu, Gillingham (GB); Alexandre C. T. Baudot, Gillingham (GB); Jonathan Gardner, Gillingham (GB)

(73) Assignee: Delphi Technologies Holding S.arl, Troy, MI (US)

( * ) Notice: Subject to any disclaimer, the term of this patent is extended or adjusted under 35 U.S.C. 154(b) by 575 days.

(21) Appl. No.: 12/287,689

(22) Filed: Oct. 10, 2008

(65) Prior Publication Data

US 2009/0097991 A1 Apr. 16, 2009

(30) Foreign Application Priority Data

Oct. 12, 2007 (EP) ..... 07254057

(51) Int. Cl.
*F04B 1/04* (2006.01)

(52) U.S. Cl. ..... 92/129; 92/72; 417/471

(58) Field of Classification Search ..... 417/273, 417/471; 92/72, 129, 491; 74/567, 569
See application file for complete search history.

(56) References Cited

U.S. PATENT DOCUMENTS

| | | | | |
|---|---|---|---|---|
| 5,785,430 | A | 7/1998 | Bright et al. | |
| 6,139,284 | A | 10/2000 | Streicher | |
| 6,250,893 | B1 | 6/2001 | Streicher | |
| 6,302,659 | B1 * | 10/2001 | Parker et al. | 417/273 |
| 6,350,107 | B1 * | 2/2002 | Hamutcu | 417/273 |
| 6,412,474 | B1 * | 7/2002 | Guentert et al. | 123/456 |
| 6,910,407 | B2 | 6/2005 | Furuta | |
| 7,108,491 | B2 * | 9/2006 | Ganser | 417/470 |
| 7,384,246 | B2 * | 6/2008 | Diaferia et al. | 417/273 |
| 2006/0216157 | A1 | 9/2006 | Breuer et al. | |
| 2006/0222517 | A1 * | 10/2006 | Breuer et al. | 417/273 |

FOREIGN PATENT DOCUMENTS

| | | |
|---|---|---|
| DE | 41 07 952 | 9/1991 |
| DE | 197 53 593 | 6/1999 |
| DE | 198 29 547 | 1/2000 |
| DE | 2 391 274 | 2/2004 |
| DE | 103 26 863 | 12/2004 |
| JP | 11-280641 | 10/1999 |
| JP | 2001-500223 | 1/2001 |
| JP | 2002-31017 | 1/2002 |
| JP | 2003-74439 | 3/2003 |
| JP | 2005-509782 | 4/2005 |
| JP | 2006-527330 | 11/2006 |

OTHER PUBLICATIONS

Japan Office Action dated Aug. 17, 2010.
European Search Report dated Mar. 11, 2008.
Japan Office Action dated Apr. 18, 2011.

* cited by examiner

*Primary Examiner* — Devon C Kramer
*Assistant Examiner* — Dominick L Plakkoottam
(74) *Attorney, Agent, or Firm* — Thomas N. Twomey

(57) ABSTRACT

A fuel pump for use in an internal combustion engine, the fuel pump comprising a pumping plunger for pressurising fuel within a pump chamber during a plunger pumping stroke, a rider member co-operable with a drive, and an interface member, for example a foot of the plunger or an intermediate tappet, for imparting drive from the rider member to the pumping plunger to perform the plunger pumping stroke. The interface member comprises an arcuate contact surface co-operable with the rider member. The inventive concept also extends to a pumping plunger for pressurising fuel within a pump chamber of a fuel pump, the pumping plunger comprising a foot having an arcuate contact surface for engaging a rider member of a fuel pump in use.

25 Claims, 5 Drawing Sheets

FUEL PUMP

TECHNICAL FIELD

The invention relates to pump assemblies of the type suitable for use in common rail fuel injection systems of internal combustion engines. In particular, though not exclusively, the invention relates to an improved pumping plunger, and an improved fuel pump of the type having at least one pumping plunger that is driven by an engine-driven cam or other appropriate drive arrangement.

BACKGROUND OF THE INVENTION

FIG. 1 depicts a conventional common rail fuel pump of radial pump design, in which a pump 100 includes three pumping plungers 102 that are arranged at equi-angularly spaced locations around an engine-driven cam 104. Each plunger 102 is mounted within a plunger bore 106 provided in a main pump housing 108. As the cam 104 is driven in use, the plungers 102 are caused to reciprocate within their bores 106 in a phased, cyclical manner. As the plungers 102 reciprocate, each causes pressurization of fuel within a pump chamber 109 defined at one end of the associated plunger bore 106. The delivery of fuel from the pump chambers to a common high pressure supply line (not shown) is controlled by means of delivery valves (not shown). The high pressure line supplies fuel to a common rail, or other accumulator volume, for delivery to downstream injectors of a common rail fuel system.

The cam 104 carries a cam ring, or cam rider 110, which is provided with a plurality of flats 112, one for each plunger 102. An intermediate member in the form of a tappet 114 co-operates with each of the flats 112 on the cam rider 110 and couples to an associated plunger 102 so that, as the tappet 114 is driven upon rotation of the cam 104, drive is imparted to the plunger 102. As each tappet 114 is driven radially outward, its respective plunger 102 is driven to reduce the volume of the pump chamber. This part of the pumping cycle is referred to as the pumping stroke of the plunger 102, during which fuel within the associated pumping chamber is pressurized to a relatively high level.

As the rider 110 rides over the cam 104 to impart drive to the tappets 114 in an axial direction, a base surface of each tappet 114 is caused to translate laterally over a co-operating region of an associated flat 112 of the rider 110. This translation of the tappets 114 with respect to the rider 110 causes friction wear of the tappets 114 and the rider 110. Friction wear particularly occurs at lateral edges of the tappets 114.

The friction wear of the tappets 114 and rider 110 of the known common rail fuel pump 100 of FIG. 1 leads not only to eventual component failure, but also to increased local operating temperatures, which in turn have a further impact on efficiency and durability of the pump 100 as a whole.

SUMMARY OF THE INVENTION

It is with a view to addressing or mitigating at least one problem of the prior art that the present invention provides an improved fuel pump and pumping plunger.

From a first aspect, the invention broadly resides in a fuel pump for use in an internal combustion engine, the fuel pump comprising a pumping plunger for pressurising fuel within a pump chamber during a plunger pumping stroke, a rider member co-operable with a drive and an interface member for imparting drive from the rider member to the pumping plunger to perform the plunger pumping stroke. The interface member comprises an integral foot of the pumping plunger having an arcuate contact surface, the arcuate contact surface being co-operable with the rider member and arranged to flatten in use.

In another aspect, the invention broadly resides in a fuel pump for use in an internal combustion engine, the fuel pump comprising a pumping plunger and a rider member, wherein the pumping plunger has an integral foot to which a drive force is applied from the rider member to perform a plunger pumping stroke, the integral foot having an arcuate contact surface co-operable with the rider member and capable of flattening in use.

As the interface member is integral with the pumping plunger the need for an intermediate member, such as a tappet, is obviated. As a result, the structure of the fuel pump is simplified and the manufacturing cost is reduced.

The arcuate contact surface reduces friction wear between the interface member and the rider member by enabling improved freedom of movement between the interface member and the rider member, particularly during translation of the interface member over the rider member in use. Additionally, friction can be further reduced due to the hydrodynamic nature of the arcuate surface, which assists in spreading lubricant.

The arcuate contact surface provides for improved freedom of movement and reduces friction wear significantly. The arcuate contact surface is advantageously arranged to flatten in use, under pressure. While flattening of the arcuate surface may have a negative effect on friction-reducing capabilities, it leads to good load distribution and helps to avoid high compression stress. It is beneficial for a balance to be struck between the advantages of mitigating friction and the advantages of avoiding or reducing high compression stress.

To enable a particularly great freedom of movement, the arcuate contact surface may conveniently be convex.

The interface member may comprise a further arcuate contact surface co-operable with the rider member, the arcuate contact surfaces together defining a combined arcuate contact surface having a varying radius of curvature. Additionally, the interface member may advantageously comprise a substantially flat contact surface co-operable with the rider member, the substantially flat surface bordering the combined arcuate contact surface. The substantially flat contact surface may conveniently be defined by a an annular bevel of the interface member.

To facilitate an edgeless transition between the combined arcuate contact surface and the substantially flat contact surface, the combined arcuate surface may comprise a first, comparatively low radius of curvature at a first point at a border with the substantially flat surface, and a second, comparatively high radius of curvature at a second point. Optionally, the radius of curvature of the combined arcuate surface may increase with increasing distance from the border with the substantially flat surface.

To help maximize the hydrodynamic properties assisting the spread of lubricant, the arcuate contact surface may preferably be part-spherical. To provide a good balance between the reduction of friction and the avoidance of high compression stress in use, the part-spherical arcuate surface may preferably have a radius of curvature within the range of 650 mm to 900 mm. Most preferably, to provide an excellent balance between the reduction of friction and the avoidance of high compression stress in use, the arcuate surface may have a radius of curvature within the range of 700 mm to 800 mm. A radius within either range may advantageously be combined with a maximum diameter section of the arcuate surface within the range of 15.2 mm to 16.2 mm.

However, the invention also extends to fuel pumps comprising an intermediate member. Thus, the interface member may alternatively comprise an intermediate tappet.

The rider member may comprise a flat for co-operating with the interface member. Additionally or alternatively, the interface member and the rider member may advantageously be arranged to provide a rotational tolerance for allowing a rotational movement of the rider member about a rider member axis. The rotational tolerance may preferably be defined by the arcuate surface of the interface member.

The provision of a rotational tolerance helps to reduce friction wear on account of any variable turning moments that may be produced between the rider member and the pumping plunger during any lateral translation of the interface member with respect to the rider member in use.

To provide a significant reduction in friction wear, the maximum rotational tolerance between a central axis of movement of the interface member and an axis of a radial driving force of the rider member may advantageously be at least 1 degree.

With regard to materials, the arcuate contact surface may be defined by a substrate of the interface member consisting of one or more materials selected from the group of: carbon steel (for example 16MnCr5); alloy steel (for example EN ISO 683-17 100Cr6+AC); and high speed steel (for example M50, M2). Additionally or alternatively, the substrate may advantageously be coated with a diamond-like carbon (DLC) coating to make it more hard-wearing and to reduce friction yet further.

From another aspect, the invention broadly resides in a pumping plunger for pressurising fuel within a pump chamber of a fuel pump, the pumping plunger comprising a foot having an arcuate contact surface for engaging a rider member of a fuel pump and being arranged to flatten in use.

To enable a particularly great freedom of movement, the arcuate contact surface may conveniently be convex.

The foot may comprise a further arcuate contact surface co-operable with the rider member, the arcuate contact surfaces together defining a combined arcuate contact surface having a varying radius of curvature. Additionally, the foot may advantageously comprise a substantially flat contact surface co-operable with the rider member, the substantially flat surface bordering the combined arcuate contact surface. The substantially flat contact surface may conveniently be defined by a an annular bevel of the foot.

To facilitate an edgeless transition between the combined arcuate contact surface and the substantially flat contact surface, the combined arcuate surface may comprise a first, comparatively low radius of curvature at a first point at a border with the substantially flat surface, and a second, comparatively high radius of curvature at a second point. Optionally, the radius of curvature of the combined arcuate surface may increase with increasing distance from the border with the substantially flat surface.

To help maximize hydrodynamic properties assisting the spread of lubricant, the arcuate contact surface may preferably be part-spherical.

The arcuate contact surface may advantageously be arranged to flatten in use, under pressure. While flattening of the arcuate surface may have a negative effect on friction-reducing capabilities, it leads to good load distribution and helps to avoid high compression stress. It is beneficial for a balance to be struck between the advantages of mitigating friction and the advantages of avoiding or reducing high compression stress.

To provide a good balance between the reduction of friction and the avoidance of high compression stress in use, the arcuate surface of the foot may preferably be part-spherical with a radius of curvature within the range of 650 mm to 900 mm. Most preferably, to provide an excellent balance between the reduction of friction and the avoidance of high compression stress in use, the arcuate surface may have a radius of curvature within the range of 700 mm to 800 mm. A radius within either range may advantageously be combined with a maximum diameter section of the arcuate surface within the range of 15.2 mm to 16.2 mm.

With regard to materials, the arcuate contact surface may be defined by a substrate of the foot consisting of one or more materials selected from the group of: carbon steel (for example 16MnCr5); alloy steel (for example EN ISO 683-17 100Cr6+AC); and high speed steel (for example M50, M2). Additionally or alternatively, the substrate may advantageously be coated with a diamond-like carbon (DLC) coating to make it more hard-wearing and to reduce friction yet further.

The pumping plunger may comprise a stem and a filleted ankle linking the foot and the stem. It has been determined that up to an ankle fillet radius of 3.5 mm, the strength of the plunger increases with an increase in fillet radius, while an increase of fillet radius beyond 3.5 mm generally does not lead to significant additional advantages. Therefore, a fillet radius in the range of 2.5 to 4.5 mm, preferably 3 mm to 4 mm, or most preferably 3.3 mm to 3.7 mm may advantageously be selected to maximize both stress resistance and space efficiency.

From another aspect, the invention broadly resides in a fuel pump comprising a pumping plunger according to the second aspect of the invention.

BRIEF DESCRIPTION OF THE DRAWINGS

The invention will now be described, by way of example only, with reference to the accompanying drawings in which.

DETAILED DESCRIPTION OF PREFERRED EMBODIMENTS

Figure 1:
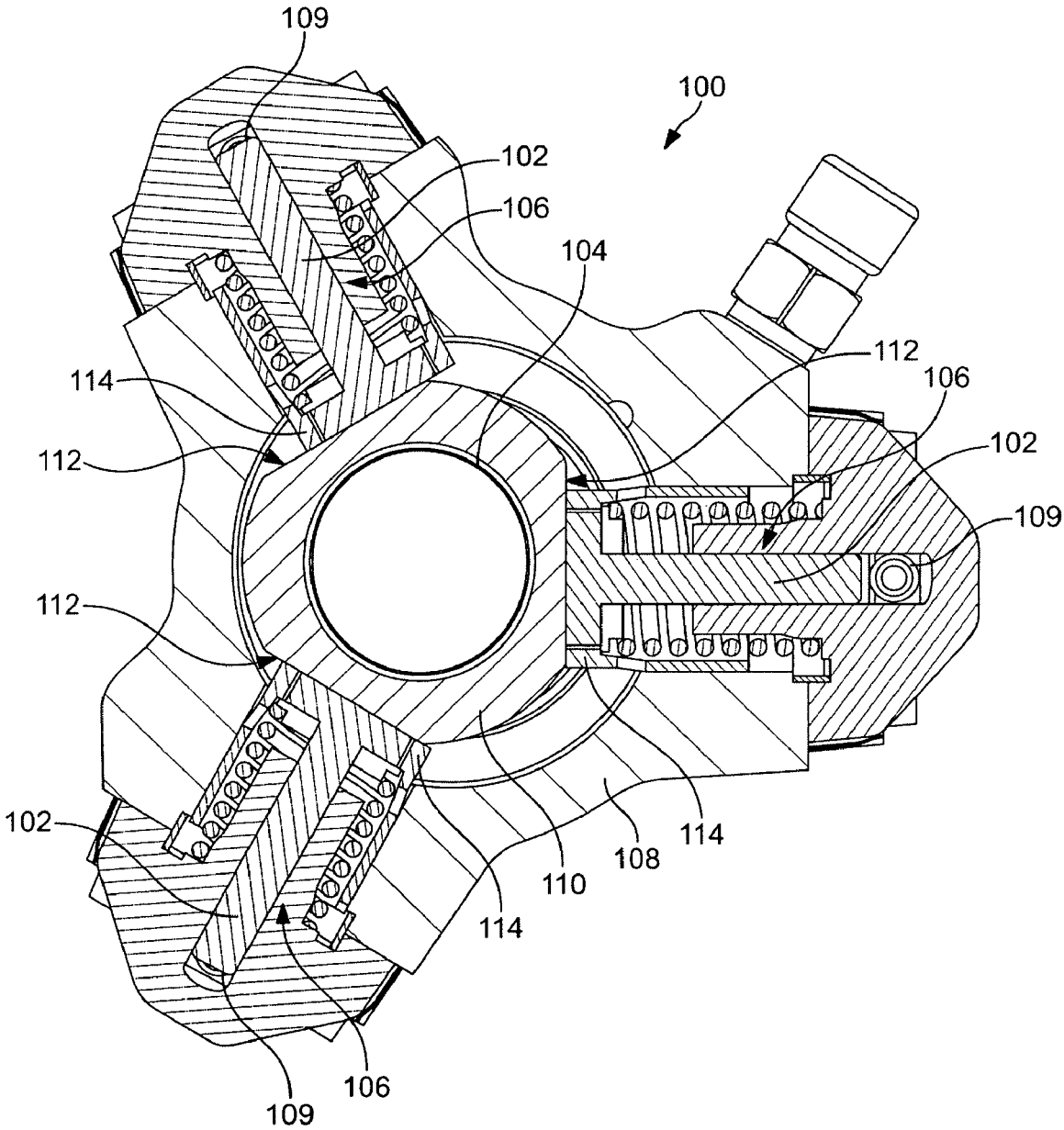
FIG. 1 (PRIOR ART)
FIG. 1 is a sectional view of a known common rail fuel pump of radial pump design
Figure 2:
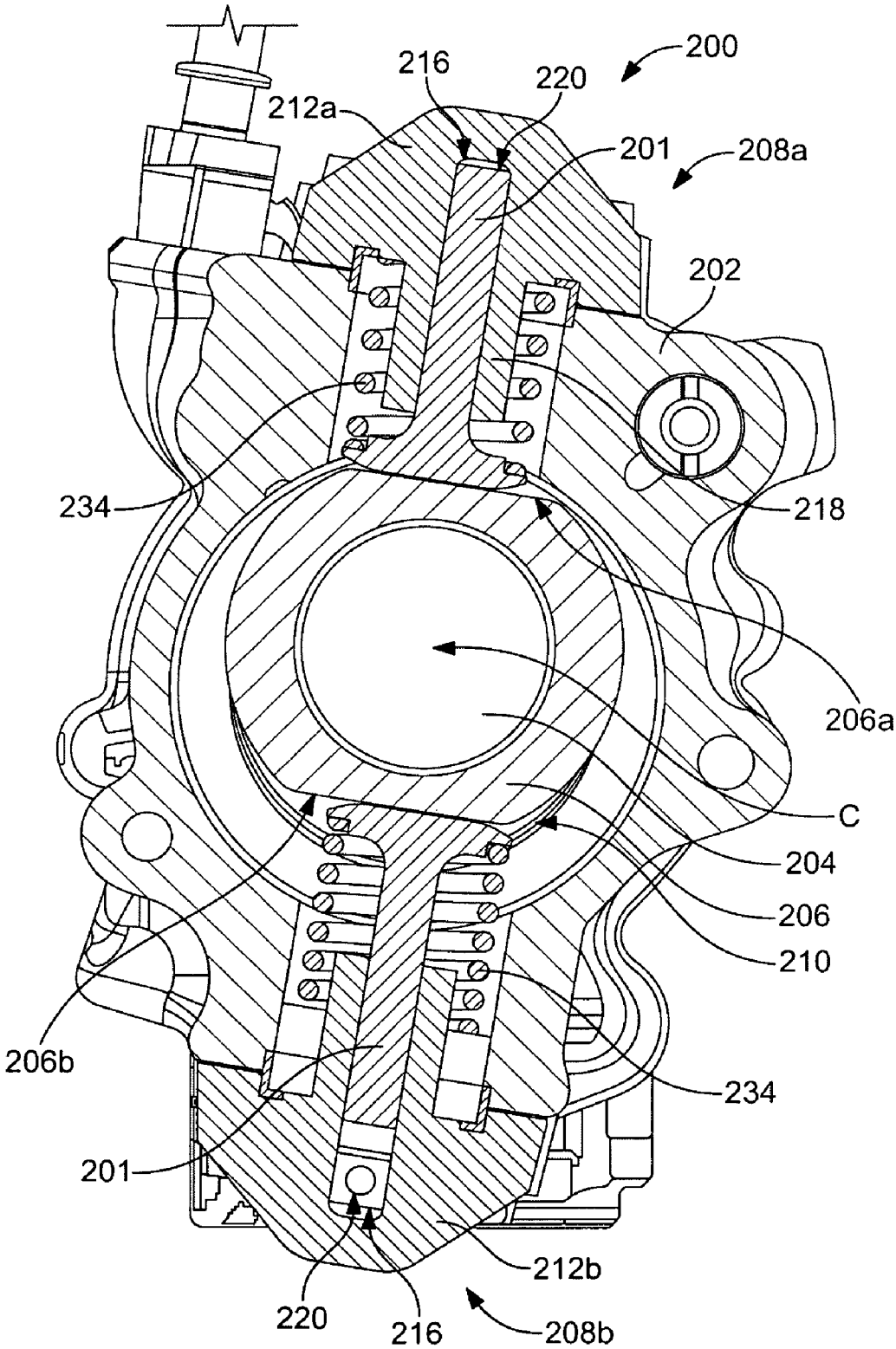
FIG. 2 is a sectional view of a fuel pump according to a first embodiment of the invention.

Referring to FIG. 2, there is shown, in a first embodiment of the invention, a high pressure fuel pump 200 suitable for use in the fuel injection system of a compression ignition internal combustion engine. In particular, the fuel pump 200 is suitable for use in delivering high pressure fuel to a common rail of a common rail fuel injection system (not shown).

Many aspects of the fuel pump 200 in FIG. 2 are known, and these parts will only be described briefly. However, the fuel pump 200 comprises improved pumping plungers 201, which help to reduce friction wear and convey manufacturing advantages.

The pump 200 includes a main pump housing 202 through which an engine-driven cam 204 extends along a central cam axis C extending perpendicularly to the plane of the page. The cam 204 carries a rider member in the form of a cam rider (or cam ring) 206 which is provided with first and second flats 206*a*, 206*b*.

First and second pump heads 208*a*, 208*b* respectively are mounted upon the main pump housing 202 at radial locations approximately opposed about the cam axis C, with the cam 204 extending through a central through bore 210 provided in the main pump housing 202. Each pump head 208*a*, 208*b* includes a respective pump head housing 212*a*, 212*b*.

The pump heads 208*a*, 208*b* are substantially identical to one another. The structure of the first pump head 208*a* will now be described, and the skilled reader will appreciate that this description applies mutatis mutandis to the second pump head 208*b*.

The first pump head 208*a* includes a pumping plunger 201 which is reciprocable within a blind plunger bore 216 to perform a pumping cycle having a pumping stroke (or forward stroke) and a spring assisted return stroke. The plunger bore 216 is defined partly within the pump head housing 212*a* and partly within a plunger support tube 218 which extends from a lower surface of the pump head housing 212*a*. The blind end of the bore 216 defines, together with the pump head housing 212*a*, a pumping chamber 220. Reciprocating movement of the plunger 201 within the bore 216 causes pressurization of fuel within the pumping chamber 220 during a pumping stroke.

Figure 3:
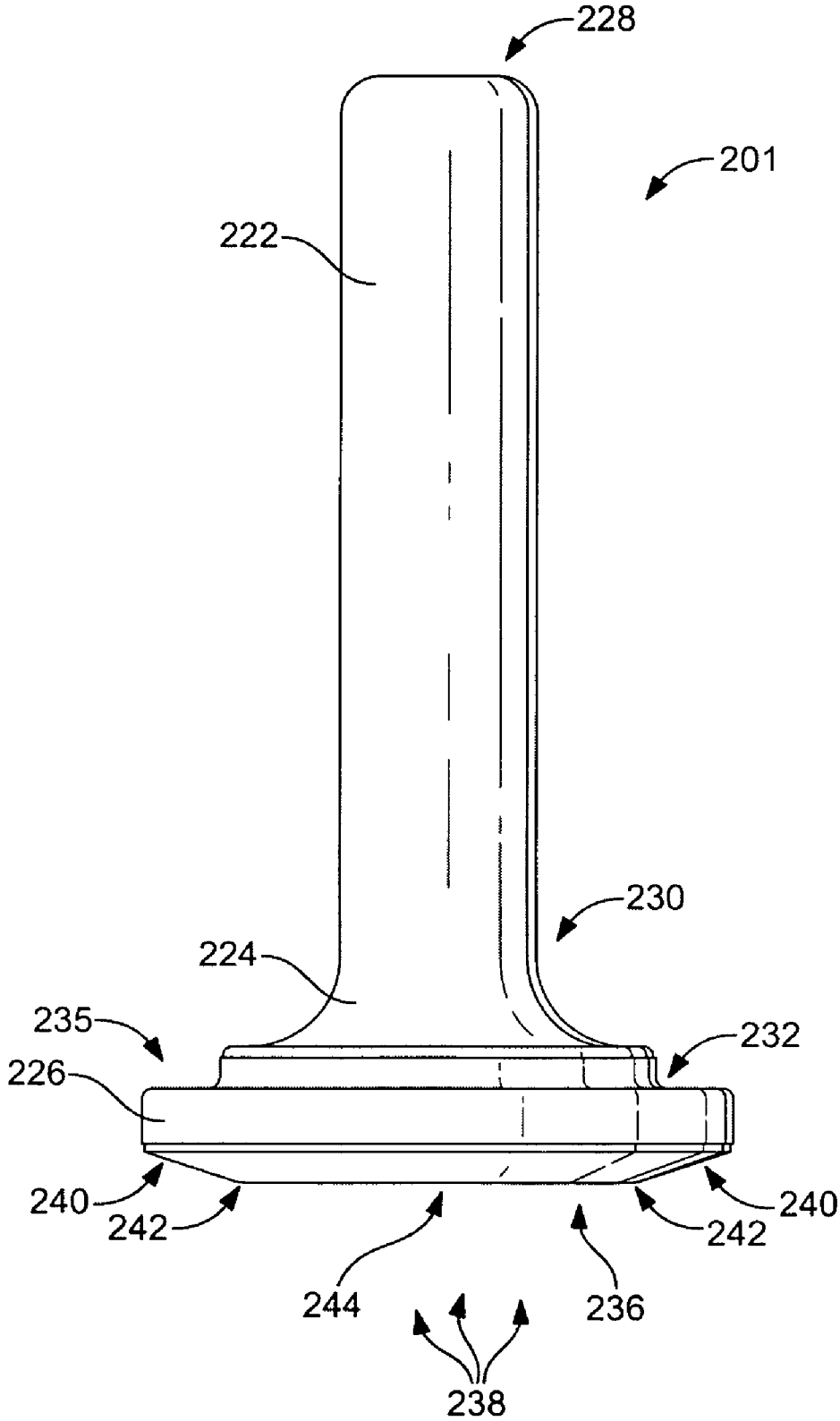
FIG. 3 is a side view of a pumping plunger of the fuel pump of FIG. 2.

Referring now to FIG. 3, the plunger 201 of the first pump head 208*a* broadly comprises a stem 222, an ankle 224, and an integral interface member in the form of a foot 226. The plunger 201 is integrally moulded from carbon steel (for example 16MnCr5), alloy steel (for example EN ISO 683-17 100Cr6+AC), or high speed steel (for example M50, M2) and may be coated with a diamond-like carbon (DLC) coating to make it more hard-wearing and to reduce friction. While a coating is not always essential, it is particularly beneficial in high pressure or high speed pumps. Alternative coatings may also be used as appropriate, depending on the structure of the pump and its application.

The stem 222 of the plunger 201 is generally cylindrical, with a radius of about 3.25 mm, and comprises a first end 228 facing the pumping chamber 220. A second, opposed end 230 of the stem 222 merges contiguously with the ankle 224. The stem 222 is radially symmetrical about a central axis A of the plunger 201 (shown in FIGS. 4*a* to 4*c*).

The ankle 224 of the plunger provides a filleted transition between the stem 222 and the foot 226. The fillet radius of the ankle 224 is selected to be about 3.5 mm. It has been determined that up to a fillet radius of 3.5 mm, the strength of the plunger increases with an increase in fillet radius, while an increase of fillet radius beyond 3.5 mm generally does not lead to significant additional advantages. Therefore, if modification is desired, a fillet radius in the range of 2.5 to 4.5 mm, preferably 3 mm to 4 mm, or most preferably 3.3 mm to 3.7 mm may be selected to maximize both stress resistance and space efficiency. However, the invention encompasses plungers having any suitable fillet radius.

To assist the pumping plunger 201 in performing a return stroke following a pumping stroke, the ankle 224 defines a stepped spring-seat 232 for receiving a helical spring 234, which is omitted from FIG. 3 for reasons of clarity but is disposed between the spring-seat 232 and the pump head housing 212*a* as shown in FIG. 2.

The foot 226 of the plunger is discoid in plan and has a radius of about 10.7 mm. The radius is determined by the geometry of spring 234, which is optimized to produce maximum stability for the rider 206: the spring is supported on the spring-seat 232 without any overhang. However, the skilled person will appreciate that the spring geometry and the radius of the foot 226 may be modified if desired.

The foot 226 comprises a distal side 235, which is contiguous with the ankle 224, and a proximal side 236 having a contact region 238 for engaging the first flat 206*a* of the cam rider 206 carried by the engine-driven cam 204. Co-operation of the cam rider 206 and the foot 226 of the plunger 201 allows drive from the cam 204 to be imparted to the plunger 201 to effect the pumping stroke.

The contact region 238 of the foot 226 of the plunger 201 comprises an annular bevel which lies at an angle of about 70 degrees to the central axis A of the plunger 201, narrowing proximally, and defining a first, substantially flat, frusto-conical contact surface 240. The first contact surface surrounds, and merges proximally with, a second, convexly arcuate, annular contact surface 242 having a radius of curvature of 3.1 mm, which in turn merges proximally with a third, convexly arcuate, part-spherical contact surface 244 having a radius of curvature of 750 mm and a diameter section of 15.2 mm. The third contact surface 244 is thus defined by a dome-shaped formation having a proximal peak at the central axis A of the plunger 201. However, as a result of its relatively high radius of curvature of 750 mm, the arcuate third contact surface 244 appears substantially flat in the relatively small scale of FIG. 3.

The second contact surface 242 serves to provide an edgeless transition between the substantially flat first contact surface 240 and the arcuate third contact surface 244 and is thus comparatively minimal in annular breadth. Expressed in another way, the third and second contact surfaces together define a combined arcuate contact surface 242, 244 having a varying radius of curvature.

Figure 4C:
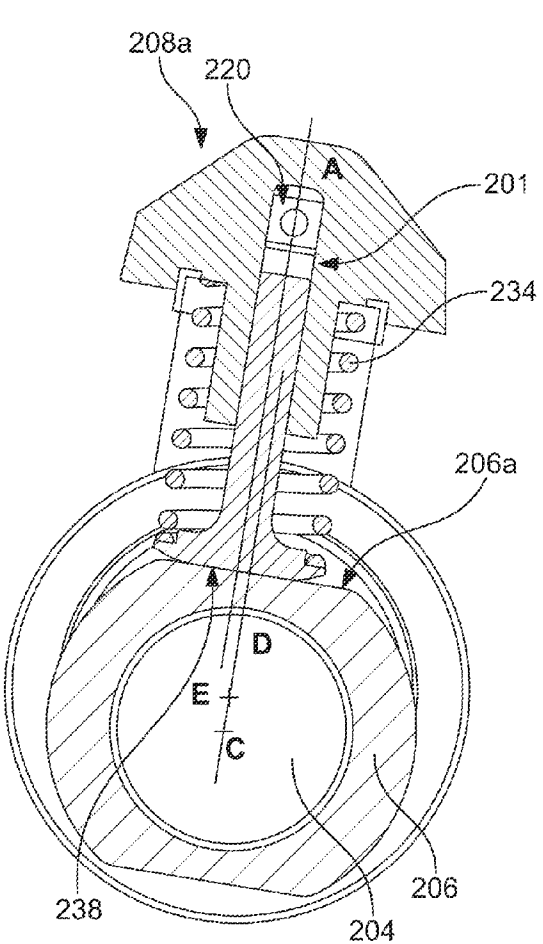
FIGS. 4*a*, 4*b* and 4*c* are sequential partial sectional views of the fuel pump of FIG. 2 showing the movement of a plunger in use.
Figure 4B:
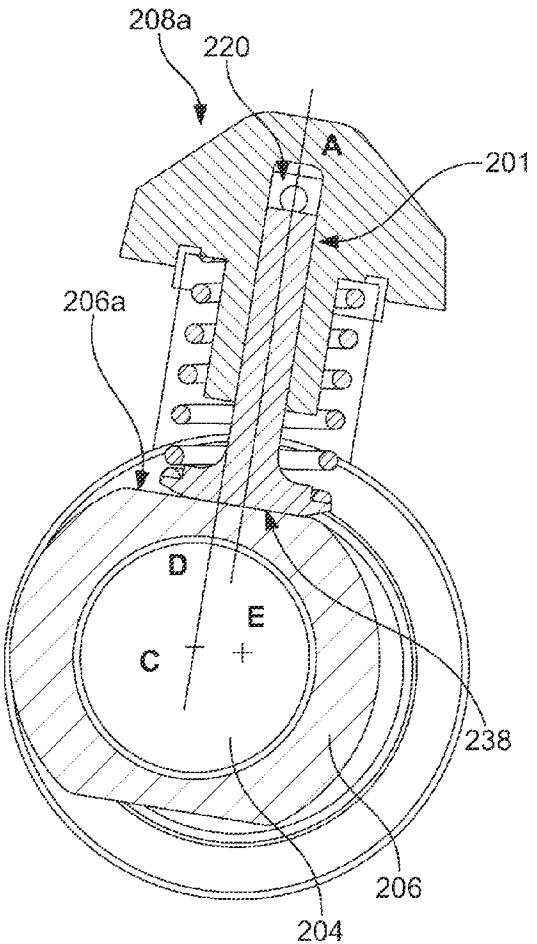
Figure 4A:
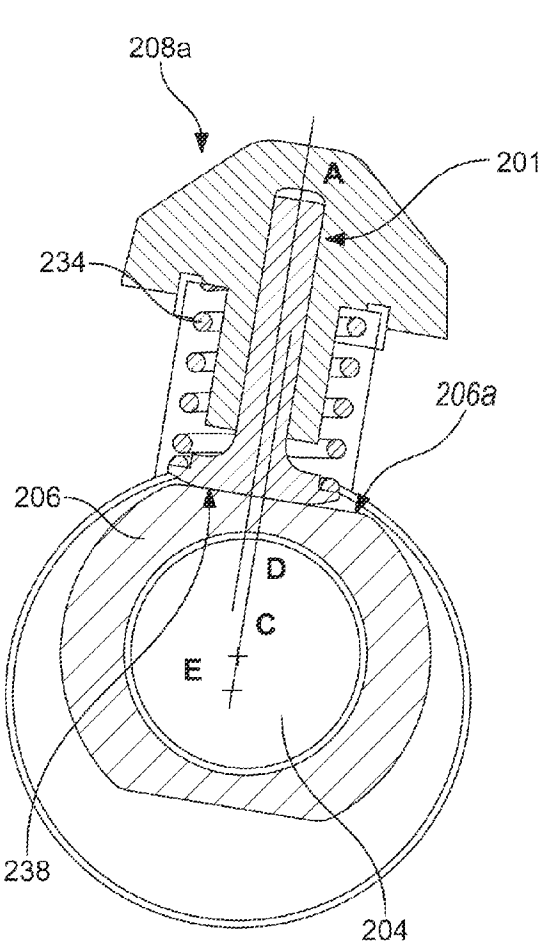

Referring again to FIG. 2, and sequential FIGS. 4*a* to 4*c*, as the cam rider 206 is caused to ride over the engine-driven cam 204, an axial drive force D is imparted to the foot 226 of the plunger 201 of the first pump head 208*a*, causing the plunger 201 to reciprocate within the plunger bore 216. During the pumping stroke, the plunger 201 is driven radially outward from the shaft to reduce the volume of the pump chamber 220. During the plunger return stroke, which is effected by means of the helical spring 234, the plunger 201 is urged in a radially inward direction to increase the volume of the pump chamber 220.

As the foot 226 of the plunger 201 is driven in a radially outward direction, leading to movement of the plunger 201 along its central axis A, a degree of lateral sliding movement of the contact region 238 of the foot 226 occurs across the associated flat 206*a* of the rider 206, in a back and forth manner. This movement is well known in the prior art and results from the movement of the cam 204 carrying the cam rider 206. The contact region 238 of the foot 226 slides across the flat 206*a* in a similar manner during the return stroke.

Referring specifically to FIGS. 4*a* to 4*c*, during the pumping stroke, the axis of the driving force D applied to the foot 226 of the plunger 201 passes through approximately the centre axis C of the cam 204 and cam rider 206. The lateral or sliding movement (or translation) of the foot 226 across the rider 206 generally leads to a misalignment of the axis of the driving force D with the central axis A of the plunger 201. This misalignment varies sinusoidally throughout the pumping cycle and causes variable turning moments (torque) to be applied between the rider 206 and the foot 226 of the plunger 201.

Reference will now be made to schematic FIG. 5, which shows the third contact surface 244 of the plunger 201 with a greatly exaggerated curvature but omits the first and second contact surfaces 242, 240 for reasons of clarity. It will be appreciated from FIG. 5 that, as the plunger 201 co-operates with (or engages) the rider 206, the convexly arcuate structure of the third contact surface 244 mitigates the friction wear caused by the sliding movement between the foot 226 and the cam rider 206 and the resulting variable turning moments, by providing a tolerance T. Specifically, small rotational movements of the rider 206 about the centre axis C of the cam 204 with respect to the plunger axis A are accommodated within the tolerance T as a result of the arcuate shape of the third contact surface 244, thereby advantageously reducing friction, and any resultant wear and heat.

Figure 5:
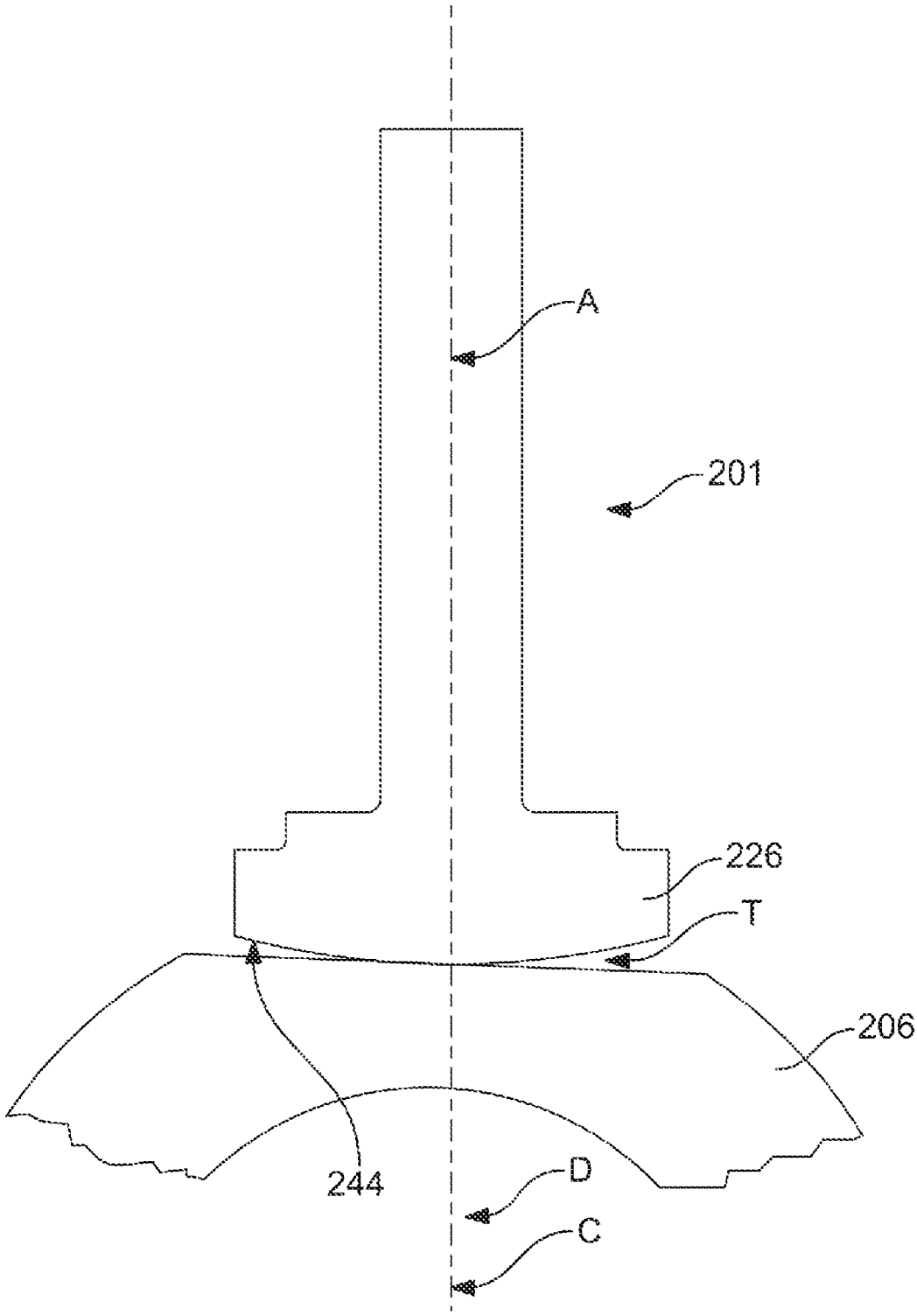
FIG. 5 is a schematic sectional view of the pumping plunger of FIG. 2 and a cam rider.

It will be appreciated from the above description of the contact region 238 of the plunger 201 that the second and first contact surfaces 242, 240, which are not shown in FIG. 5, provide further tolerance of rotational movement beyond the tolerance T where necessary. The edgeless (or seamless) transition provided by the second contact surface 242 between the third contact surface 244 and the first contact surface 240 further reduces friction in situations where such further tolerance is required: an edge (or seam) between the first contact surface 240 and the third contact surface 244 would be particularly prone to wear and could damage the cam rider 206 under pressure.

A further advantage of the contact region 238 of the foot 226 of the plunger 201 is that it is hydrodynamically shaped and, in use, assists the spread of lubricant such as fuel. The shape of the arcuate contact region, and in particular the arcuate shape of the second and third contact surfaces, facilitates the flow of lubricant between the plunger and the rider, thereby further reducing friction. The annular bevel defining the contact surface 240 also plays an important role in allowing lubricant to access the plunger/cam rider interface.

In summary, the plunger 201, by virtue of the arcuate contact region 238 of its foot 226, succeeds in significantly reducing friction at the plunger/cam rider interface. Indeed, friction is reduced so much that it has been found that an intermediate drive member such as a tappet is no longer required, contrary to the teaching of the prior art. It has conventionally been necessary to employ a tappet to prevent the variable turning moments of the cam rider from being transmitted to the pumping plunger, where they could lead to damage and/or fuel leakages. However, due to the arcuate third contact surface 244 of the pumping plunger 201 of the first embodiment of the invention, the turning moments are mitigated and an intermediate tappet is not required. Therefore, the pumping plunger 201 of the first embodiment of the invention can advantageously be brought into direct contact with the cam rider 206, which reduces costs and simplifies the fuel pump 200.

While the need for a tappet is obviated by the plunger 201 of the first embodiment of the invention, the invention nevertheless encompasses pumping assemblies including one or more intermediate interface members such tappets. For instance, the advantageous reduction of friction by an arcuate surface as described in respect of the foot of the plunger of the first embodiment can alternatively or additionally be applied to a tappet. Therefore, in a second embodiment of the invention, a high pressure fuel pump suitable for use in the fuel injection system of a compression ignition internal combustion engine comprises a fuel pump housing, one or more plungers driven by a cam carrying a cam rider, and one or more tappets acting as intermediate interface members between the plungers and the cam rider. The or each tappet comprises an arcuate contact region, as described in respect of the foot of the plunger of the first embodiment of the invention, to mitigate friction at an interface between the tappet and the cam rider.

It will be appreciated that a number of modifications can be made to the contact regions of the first and second embodiments of the invention. For instance, the additional rotational tolerance afforded by the second and first contact surfaces may not be essential in all applications in view of the initial tolerance provided by the third contact surface. Therefore, the first and second contact surfaces, although beneficial in assisting the spread of lubricant, may be omitted in some applications. Alternatively, the first contact surface may be present but act purely as a supporting feature that does not come into contact with the cam rider.

In selecting the radius of curvature and diameter section of the third contact surface, it is important to consider the amount of pressure that is applied to the contact region in use. The arcuate third contact surface generally flattens at least partially under high pressure, when in contact with the cam rider. While such flattening of the third contact surface has a negative effect on the friction-reducing capabilities of the contact region, it leads to good load distribution and helps to avoid high compression stress. Thus, in selecting the parameters of the arcuate third contact surface it is beneficial for a balance to be struck between the advantages of maintaining a curved contact surface, which mitigates angular misalignment and friction, and the advantages of allowing the contact surface to flatten, which mitigates high compression stress.

In view of the above considerations, the radius of curvature of the third contact surface of the first and second embodiments can be varied within the range of 650 mm to 900 mm (most preferably between 700 mm and 800 mm) while maintaining a good balance between the reduction of friction and the avoidance of high compression stress under fuel pump operating conditions. Although the invention is not limited to these ranges, they allow for a suitable partial flattening of the third contact surface, while simultaneously maintaining a suitable degree of angular tolerance, as discussed in respect of FIG. 5, particularly when using carbon steel, alloy steel or high speed steel. Similarly, the maximum diameter section of the third contact surface can be varied within a preferred, but non-limiting, range of 15.2 mm to 16.2 mm.

Irrespective of the selection of material and the specific shape or dimensions of the contact region, friction wear may be mitigated particularly well when the maximum rotational tolerance between the central axis A of the plunger (or tappet) and the drive axis D of the rider (before edge contact) is at least about 1 degree.

The invention claimed is:

1. A fuel pump for use in an internal combustion engine, the fuel pump comprising:

a pumping plunger extending along a central axis for pressurising fuel within a pump chamber during a plunger pumping stroke;

a rider member co-operable with a drive; and an interface member for imparting drive from the rider member to the pumping plunger to perform the plunger pumping stroke, the interface member comprising an integral foot of the pumping plunger having a flexible and resilient arcuate contact surface, the arcuate contact surface being co-operable with the rider member and arranged to flatten during the plunger pumping stroke and to rebound to its pre-flattened shape after the plunger pumping stroke.

2. The fuel pump of claim 1, wherein the arcuate surface is convex.

3. The fuel pump of claim 1, wherein the interface member comprises a further arcuate contact surface co-operable with the rider member, the arcuate contact surfaces together defining a combined arcuate contact surface having a varying radius of curvature.

4. The fuel pump of claim 3, wherein the interface member further comprises a substantially flat contact surface co-operable with the rider member, the substantially flat contact surface bordering the combined arcuate contact surface.

5. The fuel pump of claim 4, wherein the substantially flat contact surface is defined by an annular bevel of the interface member.

6. The fuel pump of claim 4, wherein the combined arcuate contact surface comprises a first radius of curvature at a first point at a border with the substantially flat contact surface, and a second radius of curvature at a second point, wherein the first radius of curvature is smaller than the second radius of curvature.

7. The fuel pump of claim 6, wherein the radius of curvature of the combined arcuate contact surface increases with increasing distance from the border with the substantially flat contact surface.

8. The fuel pump of claim 1, wherein the arcuate contact surface is part-spherical.

9. The fuel pump of claim 1, wherein the interface member further comprises an intermediate tappet.

10. The fuel pump of claim 1, wherein the rider member further comprises a flat for co-operating with the interface member.

11. The fuel pump of claim 1, wherein the interface member and the rider member are arranged to provide a rotational tolerance for allowing a rotational movement of the rider member about a rider member axis.

12. The fuel pump of claim 11, wherein the rotational tolerance is defined by the arcuate contact surface of the interface member.

13. The fuel pump of claim 11, wherein the maximum rotational tolerance between an axis of movement of the interface member and a axis of a radial driving force of the rider member is at least 1 degree.

14. A pumping plunger extending along a central axis for pressurising fuel within a pump chamber of a fuel pump during a plunger pumping stroke, the pumping plunger comprising an integral foot having a flexible and resilient arcuate contact surface for engaging a rider member of the fuel pump and being arranged to flatten during the plunger pumping stroke and to rebound to its pre-flattened shape after the plunger pumping stroke.

15. The pumping plunger of claim 14, wherein the arcuate contact surface is convex.

16. The pumping plunger of claim 14, further comprising a further arcuate contact surface for engaging the rider member in use, the arcuate contact surfaces together defining a combined arcuate contact surface having a varying radius of curvature.

17. The pumping plunger of claim 16, further comprising a substantially flat contact surface for engaging the rider member in use, the substantially flat contact surface bordering the combined arcuate contact surface.

18. The pumping plunger of claim 17, wherein the substantially flat contact surface is defined by an annular bevel of the pumping plunger.

19. The pumping plunger of claim 17, wherein the combined arcuate contact surface comprises a first radius of curvature at a first point at a border with the substantially flat surface, and a second radius of curvature at a second point, wherein the first radius of curvature is smaller than the second radius of curvature.

20. The pumping plunger of claim 14, wherein the arcuate contact surface is part-spherical.

21. A fuel pump comprising the pumping plunger according to claim 14.

22. A fuel pump for use in an internal combustion engine, the fuel pump comprising:

a pumping plunger extending along a central axis; and a rider member;

wherein the pumping plunger has an integral foot to which a drive force is applied from the rider member to perform a plunger pumping stroke, the integral foot having a flexible and resilient arcuate contact surface co-operable with the rider member and capable of flattening during the plunger pumping stroke and to rebound to its pre-flattened shape after the plunger pumping stroke.

23. The fuel pump of claim 1 wherein the arcuate contact surface has a peak at the central axis.

24. The pumping plunger of claim 14 wherein the arcuate contact surface has a peak at the central axis.

25. The fuel pump of claim 22 wherein the arcuate contact surface has a peak at the central axis.

* * * * *